US008875840B2

(12) United States Patent
Chancler

(10) Patent No.: US 8,875,840 B2
(45) Date of Patent: Nov. 4, 2014

(54) COLLAPSIBLE STOOL

(76) Inventor: Erin Marie Chancler, La Mesa, CA (US)

( * ) Notice: Subject to any disclaimer, the term of this patent is extended or adjusted under 35 U.S.C. 154(b) by 59 days.

(21) Appl. No.: 13/589,874

(22) Filed: Aug. 20, 2012

(65) Prior Publication Data

US 2013/0048428 A1 Feb. 28, 2013

Related U.S. Application Data

(60) Provisional application No. 61/525,916, filed on Aug. 22, 2011.

(51) Int. Cl.

| | |
|---|---|
| ***A47C 13/00*** | (2006.01) |
| ***E04G 1/34*** | (2006.01) |
| ***A47C 9/10*** | (2006.01) |
| ***A47C 12/00*** | (2006.01) |
| ***A47C 4/10*** | (2006.01) |

(52) U.S. Cl.

CPC ... *A47C 9/10* (2013.01); *E04G 1/34* (2013.01); *A47C 12/00* (2013.01); *A47C 4/10* (2013.01)

USPC ..... 182/33

(58) Field of Classification Search

CPC ..... A47C 4/10; A47C 9/10; A47C 12/00; E04G 1/34

USPC ..... 182/33, 155; D25/63, 65; 297/16.1, 17, 297/42, 44, 423.41; 108/167, 168, 169, 108/171, 172, 174, 125, 126, 127, 129, 130, 108/131, 132, 133

See application file for complete search history.

(56) References Cited

U.S. PATENT DOCUMENTS

| | | | | | |
|---|---|---|---|---|---|
| 155,999 | A | * | 10/1874 | Valley | 108/131 |
| 180,487 | A | * | 8/1876 | McDonal | 108/133 |
| 210,822 | A | * | 12/1878 | Thomas | 108/133 |
| 299,241 | A | * | 5/1884 | McGrath | 108/132 |
| 1,133,109 | A | * | 3/1915 | Derbyshire | 108/132 |
| 1,312,137 | A | * | 8/1919 | Schloss | 108/131 |
| 1,519,543 | A | * | 12/1924 | Kubinyi | 108/132 |
| 2,472,962 | A | * | 6/1949 | Shuflin | 108/131 |
| 2,828,173 | A | * | 3/1958 | Blink | 108/168 |
| 3,285,206 | A | * | 11/1966 | Hoffman | 108/134 |
| 3,765,718 | A | * | 10/1973 | Chen | 297/17 |
| 3,805,711 | A | * | 4/1974 | Lakso | 108/133 |
| 4,010,699 | A | * | 3/1977 | Lakso | 108/133 |
| 4,462,636 | A | * | 7/1984 | Markson | 297/423.41 |
| 6,170,405 | B1 | * | 1/2001 | Weitzman et al. | 108/25 |
| D567,395 | S | * | 4/2008 | Bishop et al. | D25/65 |
| 2004/0056517 | A1 | * | 3/2004 | Farber et al. | 297/17 |
| 2007/0101910 | A1 | * | 5/2007 | Haimoff et al. | 108/169 |
| 2010/0187041 | A1 | * | 7/2010 | Crouch | 182/223 |

* cited by examiner

*Primary Examiner* — Charles A. Fox
*Assistant Examiner* — Kristine Florio
(74) *Attorney, Agent, or Firm* — Todd J. Langford; Eric A. Hanscom

(57) ABSTRACT

A collapsible stool with foldable legs as well as a foldable seat is disclosed herein. The stool collapses to greatly reduce its size thereby enabling it to fit within many common carrying articles, such as purses. The legs and support members fold flat against the seat of the stool, which itself is in two pieces and folds in half.

18 Claims, 6 Drawing Sheets

COLLAPSIBLE STOOL

CROSS REFERENCE TO RELATED APPLICATIONS

This application claims the benefit of U.S. Provisional Patent Application No. 61/525,916 filed on Aug. 22, 2011, the entirety of which is hereby incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of stools, and more specifically toward a collapsible stool with foldable legs as well as a foldable seat. The stool collapses to greatly reduce its size thereby enabling it to fit within many common carrying articles, such as purses.

Stools have been around for thousands of years. They are a convenient place to sit as well as a handy tool when trying to obtain objects normally out of one's reach. Stools come in various sizes, from just a few inches high to many feet high, depending upon the stool's intended use. Some stools are intended more for sitting, while others are intended more for standing upon. In fact, the size of the user can also determine the best use of a particularly sized stool. For example, a smaller user, such as a child, may have an easier time sitting on a short stool, while a taller user, such as an adult, would find it uncomfortable to sit on the same stool. Likewise, a tall user may find it easy to sit on a tall stool, while a smaller user would have to climb up to sit on that same stool.

Many different materials are used to manufacture stools. Plastic, wood, and metal are the most common materials used for manufacturing stools known to the inventor, though other materials may be used. The seat of the stool often includes a cushion to make sitting on a stool more comfortable, when the stool is intended to be a seat. However, if one of the intended uses of the stool is to be stepped on, then it is preferable that the seat has a hard, non-cushioned surface as a stable stepping platform.

The prior art does have examples of stools that collapse. These stools often reduce the footprint of the stool (the width or depth of the stool) while increasing the height of the stool. This allows for more convenient storage within a house, but fails to reduce the height of the stool, making it impracticable to carry on a person, such as in a purse.

Carrying a stool can have significant benefits to parents. Children often have a difficult time reaching sinks, toilets, counters, and other common public areas because of their shorter size. Having a readily available stool would enable them to access these items without having to be held or relying on otherwise unstable platforms. Furthermore, adults themselves may benefit from having a readily available stool. The stool could be used to sit down when waiting in long lines. It could also be used as a lap tray, computer stand, desk, or footrest when such an article is otherwise unavailable.

Thus there has existed a long-felt need for a stool that easily collapses down such that the height and width of the stool are less than before, and the depth of the stool does not increase.

SUMMARY OF THE INVENTION

The current invention provides just such a solution by having a collapsible stool with foldable legs as well as a foldable seat. The stool collapses to greatly reduce its size thereby enabling it to fit within many common carrying articles, such as purses.

It is a principal object of the invention to provide a stool that easily collapses.

It is another object of the invention to provide a stool that provides a sufficiently high surface for a small person, such as a child, to gain access to objects otherwise out of reach.

It is a further object of this invention to provide a usable stool that also collapses to a size small enough to fit into a purse, handbag, or similarly sized article.

In a particular embodiment, the current invention is a collapsible stool comprising two seats, two legs, and two support members, where one seat is secured to the other seat by two seat hinges, where each seat hinge rotates about the same axis, where each seat has one of the two legs secured thereto, where each leg is secured to the seat by a leg hinge, where the leg hinge rotates about an axis that is parallel to the axis of rotation of the seat hinges; where the leg hinge is located on an opposite end of the seat from the seat hinge, where each seat has one of the two support members secured thereto, where each support member is secured to the seat by a support member hinge, where the support member hinge rotates about an axis that is perpendicular to the axis of rotation of the leg hinge, where each support member can rotate up to ninety degrees, where one support member cannot rotate passed the other, where one of the two support members comprises a spring and a latch, where the spring and latch are used to create a spring mounted latch, where the spring mounted latch can prevent the two support members from rotating away from each other, where the latch slides along an axis that is parallel to the axis of rotation of the support member hinge.

In another embodiment, the current invention is a collapsible stool comprising two seats, two legs, and two support members, where one seat is secured to the other seat by two seat hinges, where each seat hinge rotates about the same axis, where each seat has one of the two legs secured thereto, where each leg is secured to the seat by a leg hinge, where each seat has one of the two support members secured thereto, where each support member is secured to the seat by a support member hinge, where the support member hinge rotates about an axis that is perpendicular to the axis of rotation of the leg hinge.

In yet another embodiment, the current invention is a method of using a stool comprising the steps of: obtaining a stool, where the stool comprises two seats, two legs, and two support members, where one seat is secured to the other seat by two seat hinges, where each seat hinge rotates about the same axis, where each seat has one of the two legs secured thereto, where each leg is secured to the seat by a leg hinge, where each seat has one of the two support members secured thereto, where each support member is secured to the seat by a support member hinge, where the support member hinge rotates about an axis that is perpendicular to the axis of rotation of the leg hinge; rotating the two seats about the seat hinges such that the two seats are substantially coplanar; rotating each leg about the leg hinges such that the legs are substantially perpendicular to the seats; rotating each support member about the support member hinges such that the support members are substantially perpendicular to both the legs and the seats.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
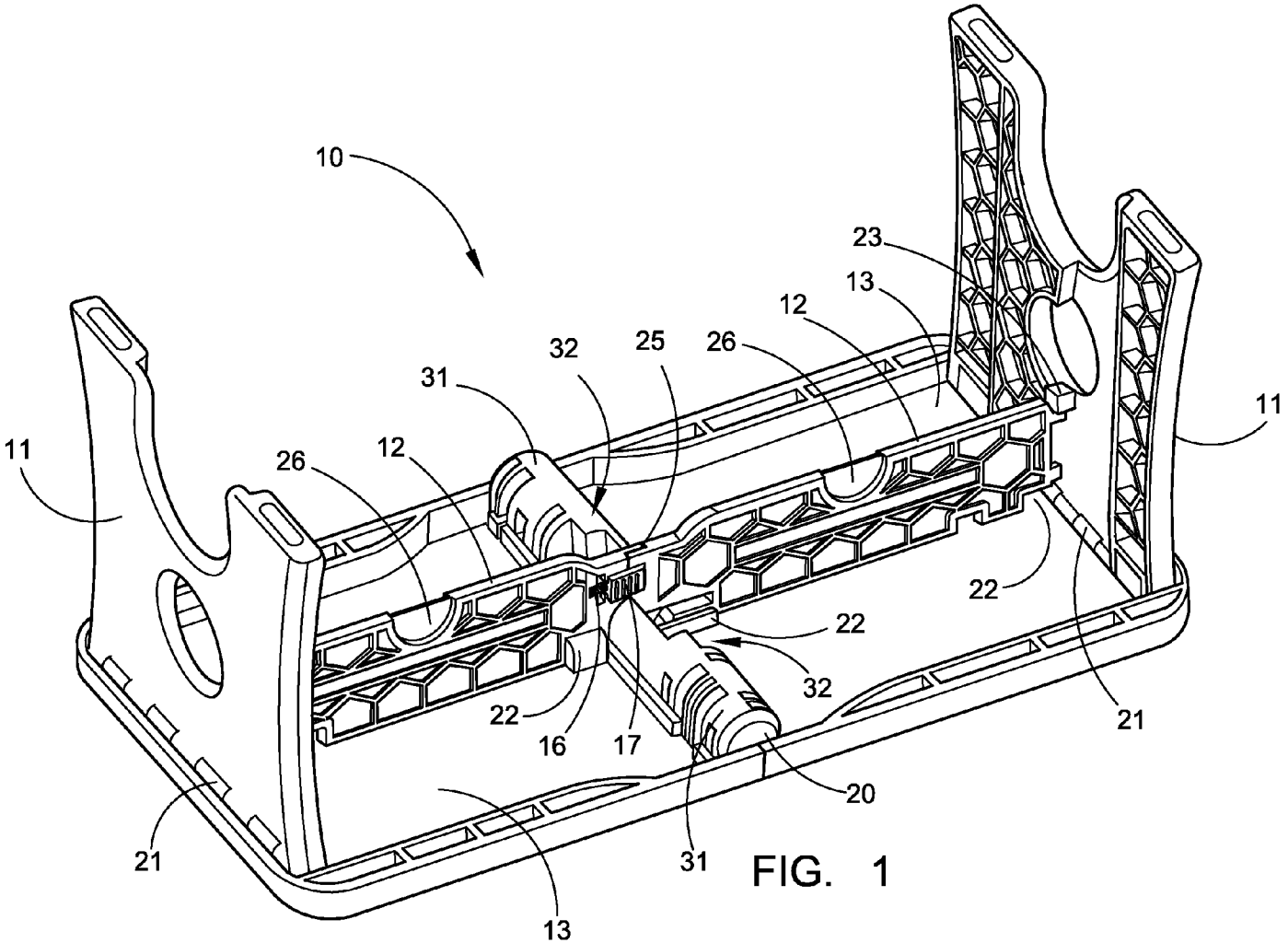
FIG. 1 is a bottom perspective view of a stool according to selected embodiments of the current disclosure.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is a bottom perspective view of a stool according to selected embodiments of the current disclosure. The stool 10 includes two seats 13 that are connected to each other by a seat hinge 20. The seat hinge 20 includes two hinge members 31 that enable the seats 13 to rotate towards and away from each other. Each seat 13 has a leg 11 attached thereto by means of a leg hinge 21. The leg 11 rotates about the leg hinge 21 towards the seat 13 when in a collapsed configuration, and away from the seat to a perpendicular orientation when in use. The stool 10 also includes two support members 12. These support members 12 rotate about support member hinges 22 that enable each support member 12 to rotate towards and away from the seat 13.

The stool 10 in FIG. 1 is configured for use. The legs 11 are substantially perpendicular to the seat, as are the support members 12, and the legs 11 are prevented from rotating towards the seats by the support members 12. In fact, when in use, the legs are perpendicular to both the support members 12 and the seats 13. To collapse the stool 10, the support members 12 are released by sliding a latch 17 (discussed in more detail below) and are rotated about the support member hinges 22 towards the seats 13. A user may grasp depressions 26 in the support member 12 to rotate them towards the seat 13. The ends of the support member 12 that are closest to the seat hinge 20 fold into cutouts 32 in the hinge members 31. In this fashion, each support member 12 folds in an opposite direction. After the support members 12 are laid flat (parallel) to the seats 13, the legs 11 may fold towards the seat 13 about the leg hinges 21. Finally, the two seats 13 are rotated about the seat hinges 20 from being coplanar to residing adjacent to each other in parallel planes. Configuring the stool for use from a collapsed configuration follows the same steps as above, but in reverse. The seats 13 are rotated about the seat hinge 20 until they are substantially coplanar. The legs 11 are unfolded away from the seats 13 and then the support members 12 are folded away from the seats 13 and locked into place. The ends of the support members meet at a support member meeting point 25. In a particular embodiment, each end of the support member is "L" shaped, whereby the two ends of the support members 12 mate together. In an alternative embodiment, each end of the support member has a diagonally angled end. A receiver tab 23 in each leg 11 is used to removably lock its corresponding support members 12. In an alternative embodiment, the receive tab is not incorporated into the design; rather, the support members are restrained simply using the latch described in more detail below. Since each leg folds flat against its corresponding seat part, the height and width of each leg should be less than the length and width of each seat portion.

Each seat hinge 20 may include a metal shaft (not shown) about which the hinge members 31 of each seat rotate. While the metal shaft is preferably made from a metallic material such as steel or aluminum, the hinge members are preferably made from the same material as the rest of the seat 13, such that it may be molded as one continuous piece. Each seat hinge rotates about the same axis, and would be one continues hinge if the two hinges were not separated in the middle. As used herein, the description of a hinge rotating about a particular axis is equivalent to saying that each member secured to the hinge rotates about that particular axis.

The support members 12 may each rotate to one side only, where each of the two support members rotate to an opposite side. As shown in the drawings, the meeting point 25 allows each member to rotate toward the other when unfolding the stool for use, but each support member 12 cannot rotate past the other. In this manner, each support member only rotates a maximum of ninety degrees. One of the two support members 12 is provided with a spring-mounted latch that includes a spring 16 and a latch 17. The latch 17 acts to prevent the opposing support member 12 from rotating away from the first support member 12. However, a user may slide the latch 17 against the force of the spring 16 to allow the opposing support member 12 to rotate away from the first support member 12 to collapse the stool 10 as described above. In an alternative embodiment, both support members include such a spring-mounted latch, whereby a user must slide both latches to release the support members from each other.

Figure 2:
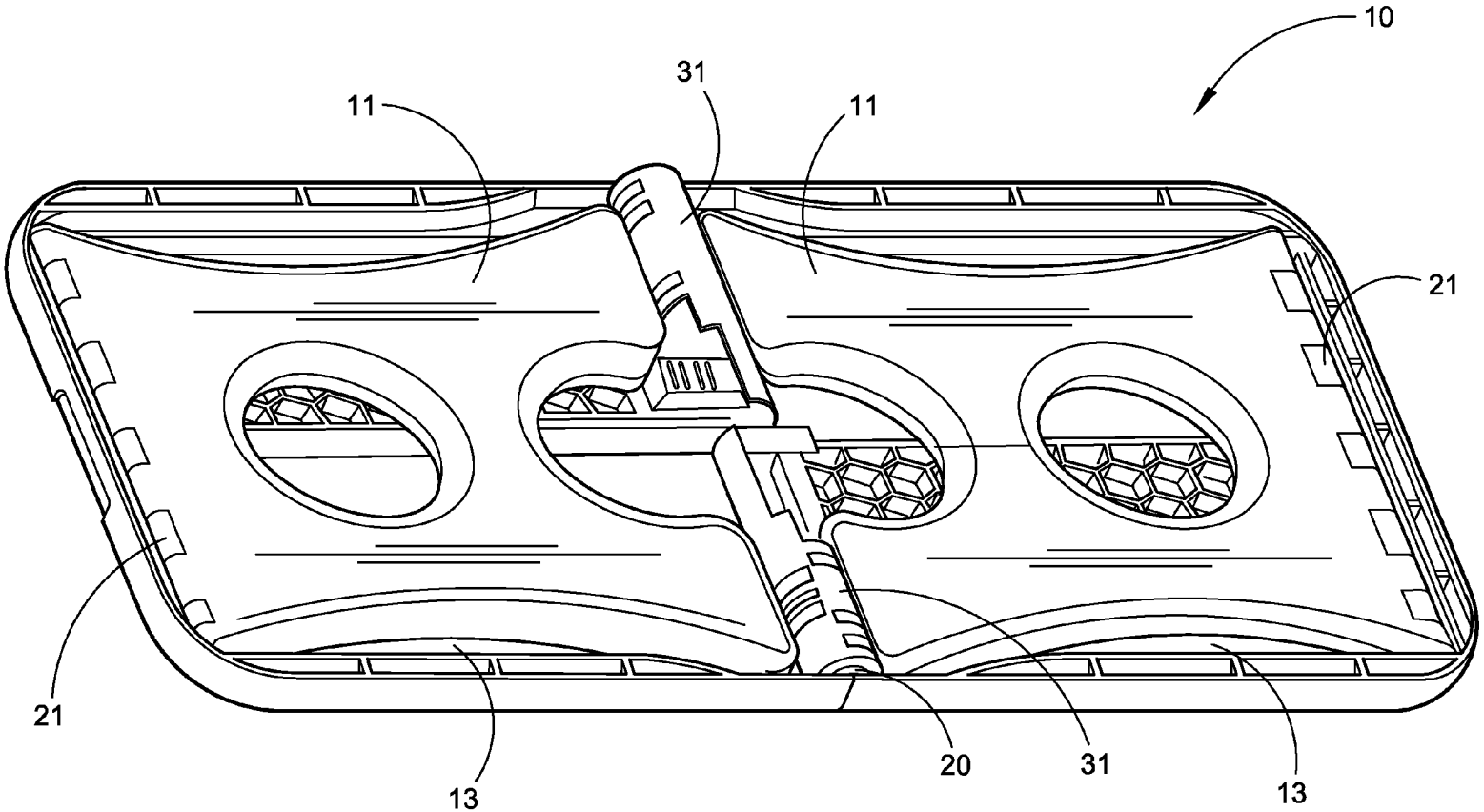
FIG. 2 is a bottom perspective view of a partially collapsed stool according to selected embodiments of the current disclosure.

FIG. 2 is a bottom perspective view of a partially collapsed stool according to selected embodiments of the current disclosure. The legs 11 are shown collapsed, whereby they have been folded towards the seats 13 around leg hinges 21.

Figure 3:
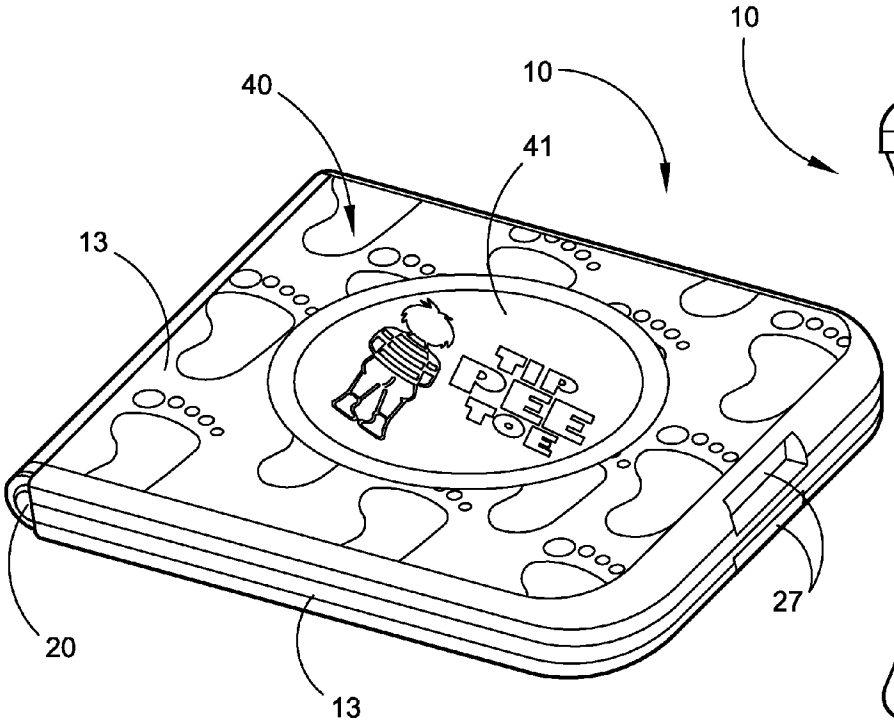
FIG. 3 is a top view of a fully collapsed stool according to selected embodiments of the current disclosure.

FIG. 3 is a top view of a fully collapsed stool according to selected embodiments of the current disclosure. The seats 13 are folded together about seat hinge 20. As shown in this figure, the seat 13 includes patterns 40 and a logo 41. The pattern 40 is used to create a textured surface on the seat, which provides a sufficiently frictional surface for standing and/or sitting. The logo 41 may also aid in providing a textured surface, but may also including distinguishing marks or other information. While a user may push the two seats together to complete the collapse of the stool, grasping cutouts 27 may be used to aid the user in pulling apart the seats when unfolding the stool.

The stool 10 may also includes a means of securing to the two seats 13 together when in a folded positions, such as that shown in FIG. 3. For example, mating snaps may be used such that when the two seats 13 are pushed together, the snaps bias the seats 13 to remain in a collapsed configuration. At the same time, the user may use the grasping cutouts 27 to pull the two seats 13 apart and overcome the biasing forces provided by the snaps.

As can be seen in FIG. 3, the fully collapsed stool is greatly reduced in size. Its height has been greatly decreased, as the legs and support members are collapsed such that the seats, legs, and support members are substantially coplaner. Furthermore, the width of the stool is also cut in half, since the seats 13 fold about the seat hinge to mate with one another.

Figure 4:
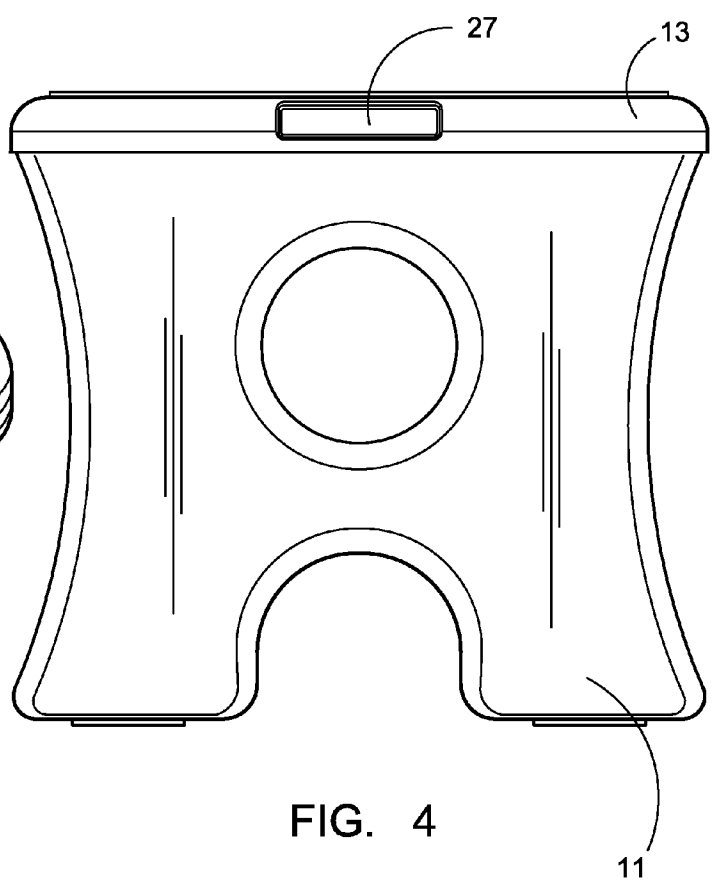
FIG. 4 is a side view of a stool according to selected embodiments of the current disclosure.

FIG. 4 is a side view of a stool according to selected embodiments of the current disclosure. The legs 11 are extended and provide support to the seats 13.

Figure 5:
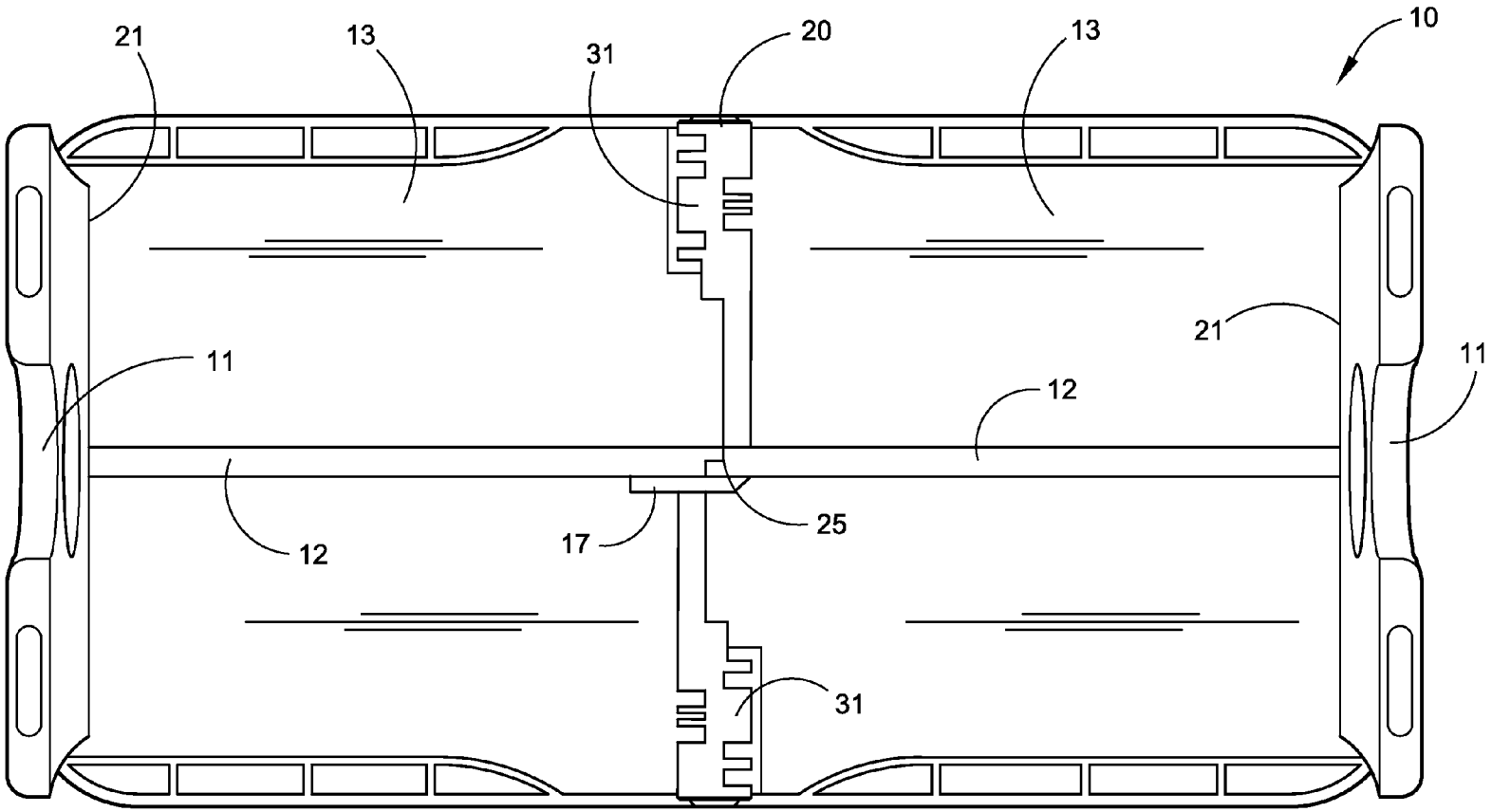
FIG. 5 is a bottom view of a stool according to selected embodiments of the current disclosure.

FIG. 5 is a bottom view of a stool according to selected embodiments of the current disclosure. The support members 12 are unfolded and meet each other at the support member meeting point 25. Latch 17 prevents support members 12 from rotating away from each other. However, a user may slide latch 17 on an axis that is parallel to the length of the support member 12 to which it is affixed to release the opposing support member thereby allowing each support member to rotate away from the other.

Figure 6:
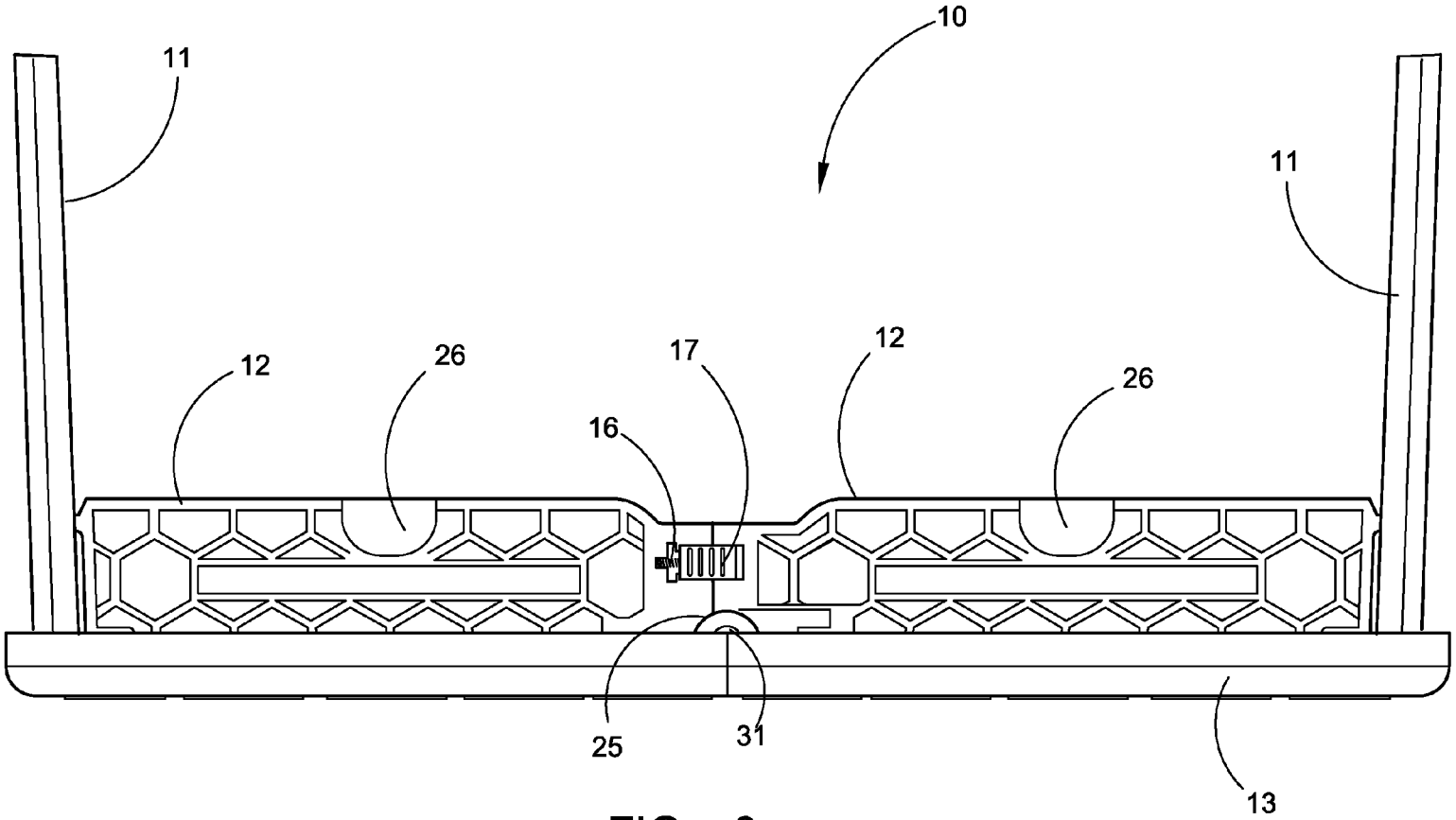
FIG. 6 is a front view of a stool according to selected embodiments of the current disclosure.

FIG. 6 is a front view of a stool according to selected embodiments of the current disclosure. The stool 10 is configured for use, with the legs 11 and support members 12 extended. As a force is applied to the seats 13 (such as when standing or sitting upon the stool 10), these forces are transferred to the support members 12 and to the legs 11, whereby the legs provide the vertical support for the stool 10.

Figure 7:
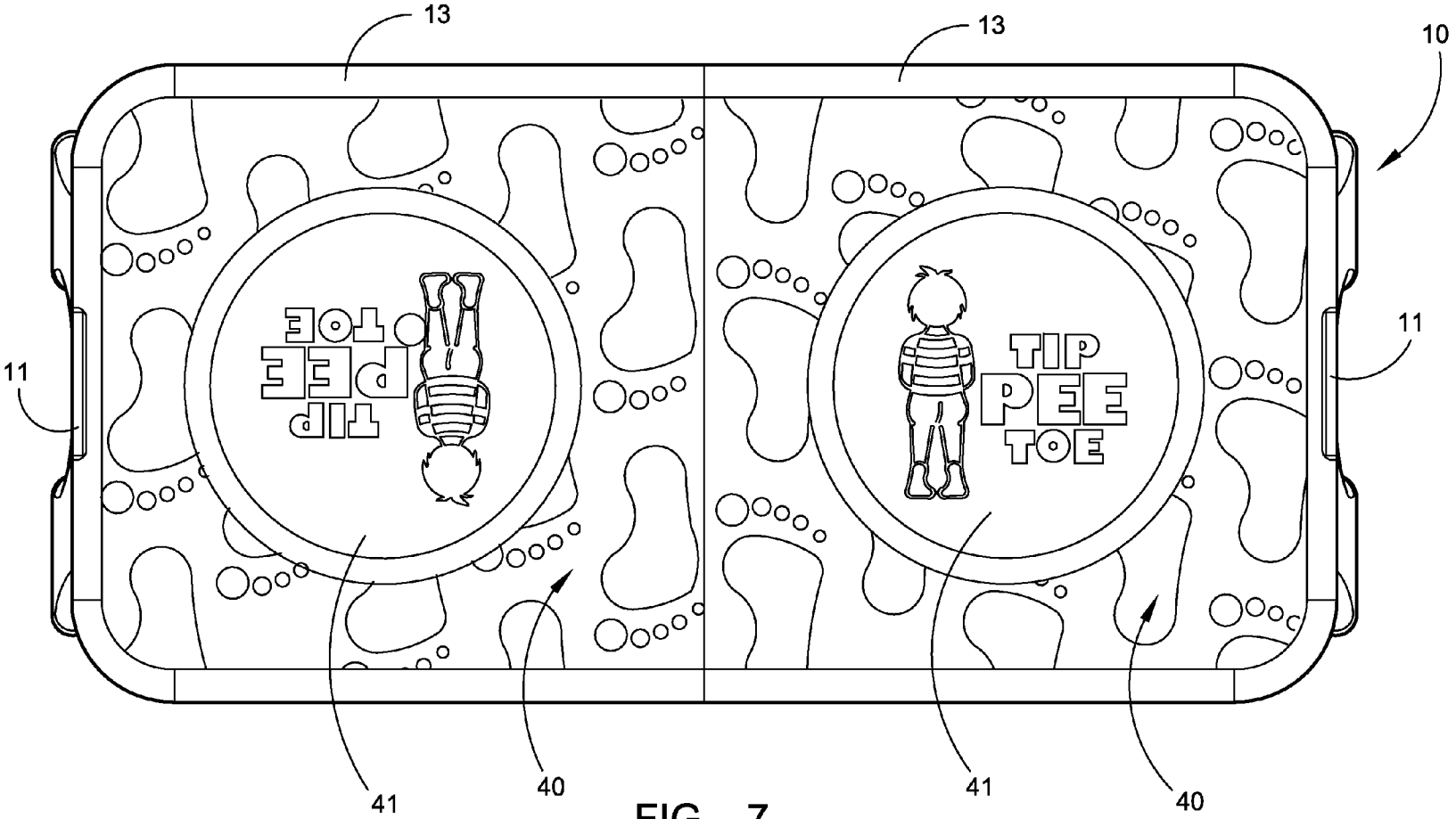
FIG. 7 is a top view of a stool according to selected embodiments of the current disclosure.

FIG. 7 is a top view of a stool according to selected embodiments of the current disclosure. The pattern 40 preferably extends across the majority of the top surface of the seats 13. The logos 41 are also preferably rotated 180° from the other, whereby one of the logos 41 is oriented in a proper reading direction when viewed by a user from either side of the stool 10. Alternatively, the logos 41 may be oriented in the same direction, whereby there is a clearer front and back to the stool 10.

A honeycomb structure may be used in the various components of the stool. The honeycomb structure provides sufficient structural integrity to components such as the legs and support members while at the same time reducing the amount of material required and overall weight of the stool. This is particularly useful when the components are made of plastic, as the molds used to create the parts may incorporate such a design at relatively little additional cost. Furthermore, non-skid pads may be incorporated into the bottom of the legs. These non-skid pads are preferably made from rubber or some other material with a high coefficient of friction thereby providing a more stable platform from which a person may step or sit.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

That which is claimed:

1. A collapsible stool comprising two seats, two legs, and two support members, where one seat is secured to the other seat by two seat hinges, where each seat hinge rotates about the same axis, where each seat has one of the two legs secured thereto, where each leg is secured to the seat by a leg hinge, where the leg hinge rotates about an axis that is parallel to the axis of rotation of the seat hinges; where the leg hinge is located on an opposite end of the seat from the seat hinge, where each seat has one of the two support members secured thereto, where each support member is secured to the seat by a support member hinge, where the support member hinge rotates about an axis that is perpendicular to the axis of rotation of the leg hinge, where each support member can rotate up to ninety degrees, where one support member cannot rotate passed the other, where one of the two support members comprises a spring and a latch, where the spring and latch are used to create a spring mounted latch, where the spring mounted latch can prevent the two support members from rotating away from each other, where the latch slides along an axis that is parallel to the axis of rotation of the support member hinge.

2. The collapsible stool of claim 1, wherein the other of the two support members also comprises a spring and a latch, where the spring and latch are used to create a spring mounted latch, where the spring mounted latch can prevent the two support members from rotating away from each other, where the latch slides along an axis that is parallel to the axis of rotation of the support member hinge.

3. The collapsible stool of claim 1, wherein each seat hinge comprises a cutout, where a portion of a support member is allowed to rotate into the cutout.

4. The collapsible stool of claim 1, wherein each seat comprises a grasping cutout.

5. The collapsible stool of claim 1, wherein each seat comprises a pattern and a logo.

6. The collapsible stool of claim 1, wherein the two legs have a width and height that is less than the width and length of the two seats.

7. A collapsible stool comprising two seats, two legs, and two support members, where one seat is secured to the other seat by two seat hinges, where each seat hinge rotates about the same axis, where each seat has one of the two legs secured thereto, where each leg is secured to the seat by a leg hinge, where each seat has one of the two support members secured thereto, where each support member is secured to the seat by a support member hinge, where the support member hinge rotates about an axis that is perpendicular to the axis of rotation of the leg hinge, where one of the two support members comprises a spring and a latch, where the spring and latch are used to create a spring mounted latch, where the spring mounted latch prevents the two support members from rotating away from each other, where the latch slides along an axis that is parallel to the axis of rotation of the support member hinge.

8. The collapsible stool according to claim 7, where the leg hinge rotates about an axis that is parallel to the axis of rotation of the seat hinges; where the leg hinge is located on an opposite end of the seat from the seat hinge.

9. The collapsible stool according to claim 7, where each support member can rotate up to ninety degrees, where one support member cannot rotate passed the other.

10. The collapsible stool of claim 7, wherein each of the two support members comprises a depression.

11. The collapsible stool of claim 7, wherein each seat hinge comprises a cutout, where a portion of a support member is allowed to rotate into the cutout.

12. The collapsible stool of claim 7, wherein each seat comprises a grasping cutout.

13. The collapsible stool of claim 7, wherein each seat comprises a pattern and a logo.

14. The collapsible stool of claim 7, wherein the two legs have a width and height that is less than the width and length of the two seats.

15. A method of using a stool comprising the steps of:

obtaining a stool, where the stool comprises two seats, two legs, and two support members, where one seat is secured to the other seat by two seat hinges, where each seat hinge rotates about the same axis, where each seat has one of the two legs secured thereto, where each leg is secured to the seat by a leg hinge, where each seat has one of the two support members secured thereto, where each support member is secured to the seat by a support member hinge, where the support member hinge rotates about an axis that is perpendicular to the axis of rotation of the leg hinge, wherein one of the two support members comprises a spring and a latch, where the spring and latch are used to create a spring mounted latch, where the spring mounted latch can prevent the two support members from rotating away from each other, where the latch slides along an axis that is parallel to the axis of rotation of the support member hinge;

rotating the two seats about the seat hinges such that the two seats are substantially coplanar;

rotating each leg about the leg hinges such that the legs are substantially perpendicular to the seats;

rotating each support member about the support member hinges such that the support members are substantially perpendicular to both the legs and the seats.

16. The method of claim 15, further comprising the step of sliding the latch.

17. The method of claim 15, further comprising the steps of:

rotating each support member about the support member hinges such that the support members are in a substantially parallel plane to the seats;

rotating each leg about the leg hinges such that the legs are in a substantially parallel plain to the seats;

rotating the two seats about the seat hinges such that the two seats are in substantially parallel planes.

18. The method of claim 15, wherein one support member cannot rotate past the other support member.

* * * * *